US009192203B2

(12) United States Patent
Perthou

(10) Patent No.: US 9,192,203 B2
(45) Date of Patent: Nov. 24, 2015

(54) HEAD COVERING

(71) Applicant: Peter Perthou, Gloucester, MA (US)

(72) Inventor: Peter Perthou, Gloucester, MA (US)

( * ) Notice: Subject to any disclaimer, the term of this patent is extended or adjusted under 35 U.S.C. 154(b) by 0 days.

(21) Appl. No.: 13/622,057

(22) Filed: Sep. 18, 2012

(65) Prior Publication Data

US 2014/0075647 A1 Mar. 20, 2014

(51) Int. Cl.
*A42B 1/02* (2006.01)
*A42B 1/04* (2006.01)

(52) U.S. Cl.
CPC .. *A42B 1/02* (2013.01); *A42B 1/041* (2013.01)

(58) Field of Classification Search
CPC ..... A42B 1/041; A42B 1/066; A42B 1/02; A42B 1/248; A42B 1/061; A42B 1/043; A42C 5/00
USPC ..... 2/171.04, 172, 175.1, 175.2, 175.3, 2/195.1, 195.5, 195.7
See application file for complete search history.

(56) References Cited

U.S. PATENT DOCUMENTS

| | | | | | |
|---|---|---|---|---|---|
| 224,745 | A | * | 2/1880 | Trested | 2/200.1 |
| 238,878 | A | * | 3/1881 | Finster et al. | 2/172 |
| 442,921 | A | * | 12/1890 | Stohr | 2/172 |
| 776,261 | A | * | 11/1904 | Rogers | 2/171.04 |
| 811,178 | A | * | 1/1906 | Saks | 2/172 |
| 978,048 | A | * | 12/1910 | Monoson | 2/181 |
| 1,050,310 | A | * | 1/1913 | Steinberg | 2/172 |
| 1,207,420 | A | * | 12/1916 | Levinson | 2/172 |
| 1,330,299 | A | * | 2/1920 | Ballard | 2/195.7 |
| 1,386,890 | A | * | 8/1921 | Matyk | 2/195.7 |
| 1,505,183 | A | * | 8/1924 | Zucker | 2/172 |
| 1,529,300 | A | * | 3/1925 | Cook | 2/172 |
| 1,533,624 | A | * | 4/1925 | Weinrott | 2/171.5 |
| 1,558,142 | A | * | 10/1925 | Brenner | 2/181 |
| 1,598,287 | A | * | 8/1926 | Larson | 2/195.7 |
| 1,598,314 | A | * | 8/1926 | Rosenberg | 2/171.1 |
| 1,616,475 | A | * | 2/1927 | Tracey | 2/195.7 |
| 1,652,723 | A | * | 12/1927 | Mason | 2/195.7 |
| 1,747,918 | A | * | 2/1930 | Weingart | 2/195.7 |
| 1,886,992 | A | * | 11/1932 | Wagenfeld | 2/195.7 |
| 1,904,108 | A | * | 4/1933 | Walsh | 2/195.7 |
| 2,003,367 | A | | 6/1935 | Julich | |
| 2,143,265 | A | * | 1/1939 | Goldstein | 2/172 |
| 2,192,341 | A | * | 3/1940 | Dahlberg | 2/203 |
| 2,343,758 | A | * | 3/1944 | Etman | 2/195.7 |
| 2,685,090 | A | * | 8/1954 | Wagenfeld | 2/195.7 |
| 2,717,394 | A | * | 9/1955 | Portis | 2/172 |
| 2,735,110 | A | * | 2/1956 | Baker | 2/209.12 |
| 2,844,822 | A | * | 7/1958 | Persico et al. | 2/172 |
| 2,885,683 | A | * | 5/1959 | Lipkin | 2/172 |
| 2,948,900 | A | * | 8/1960 | Ebenstein | 2/195.7 |
| 3,089,147 | A | * | 5/1963 | Zimmermann | 2/195.1 |

(Continued)

FOREIGN PATENT DOCUMENTS

FR 2180429 11/1973

OTHER PUBLICATIONS

International Search Report and Written Opinion from corresponding Application No. PCT/US2013/059900, dated Dec. 12, 2013, 11 pages.

*Primary Examiner* — Danny Worrell
(74) *Attorney, Agent, or Firm* — Fish & Richardson P.C.

(57) ABSTRACT

A head covering includes a top fastened to a cylindrical wall. The bottom of the cylindrical wall is folded outwardly and upwardly to form a rim which is connected to a rear point of the top.

5 Claims, 5 Drawing Sheets

(56) References Cited

U.S. PATENT DOCUMENTS

| | | | | | |
|---|---|---|---|---|---|
| 3,134,983 | A | * | 6/1964 | Lipkin | 2/172 |
| 3,188,654 | A | * | 6/1965 | Rafowitz et al. | 2/172 |
| 3,247,523 | A | * | 4/1966 | Lipkin | 2/172 |
| 3,276,038 | A | * | 10/1966 | Fekete | 2/172 |
| 3,337,877 | A | * | 8/1967 | Lipkin | 2/172 |
| 3,358,292 | A | * | 12/1967 | Bonk et al. | 2/172 |
| 3,376,580 | A | * | 4/1968 | Ashmore | 2/195.7 |
| 3,384,904 | A | * | 5/1968 | Hofmann | 2/195.7 |
| 3,414,906 | A | * | 12/1968 | Bonk et al. | 2/172 |
| 3,419,910 | A | * | 1/1969 | Welch | 2/195.7 |
| 3,473,168 | A | * | 10/1969 | Gallin | 2/171.04 |
| 3,555,565 | A | * | 1/1971 | Zimmon et al. | 2/195.7 |
| 3,571,812 | A | * | 3/1971 | Speevak et al. | 2/195.7 |
| 3,602,918 | A | * | 9/1971 | Krystal | 2/195.7 |
| 3,618,140 | A | * | 11/1971 | Goldfarb | 2/207 |
| 3,855,634 | A | * | 12/1974 | Gregg | 2/172 |
| 3,910,292 | A | * | 10/1975 | Izzo | 132/53 |
| 4,023,212 | A | * | 5/1977 | Huffman | 2/195.2 |
| 4,141,229 | A | * | 2/1979 | Sharpe | 66/171 |
| 4,370,756 | A | * | 2/1983 | Gallin | 2/195.7 |
| 4,491,985 | A | * | 1/1985 | Dalton | 2/172 |
| 4,551,859 | A | * | 11/1985 | Gerhardt | 2/172 |
| 4,608,721 | A | * | 9/1986 | Lipkin | 2/172 |
| 4,937,885 | A | * | 7/1990 | Gregg | 2/209.11 |
| 4,951,319 | A | * | 8/1990 | Phillips et al. | 2/172 |
| 5,351,343 | A | * | 10/1994 | Harbison | 2/423 |
| 5,455,970 | A | * | 10/1995 | Vance et al. | 2/171.04 |
| D378,948 | S | * | 4/1997 | Ragus | D2/866 |
| 5,664,261 | A | * | 9/1997 | Lacy | 2/172 |
| D398,741 | S | * | 9/1998 | Ella | D2/887 |
| 5,806,535 | A | * | 9/1998 | Becker | 132/54 |
| 5,845,338 | A | * | 12/1998 | Clark | 2/195.1 |
| 6,122,774 | A | * | 9/2000 | Park | 2/181 |
| 6,463,592 | B1 | * | 10/2002 | Brooks | 2/209.12 |
| 6,643,848 | B1 | | 11/2003 | May | |
| 6,704,940 | B1 | * | 3/2004 | Convery et al. | 2/175.1 |
| D517,780 | S | * | 3/2006 | Kim | D2/882 |
| D617,536 | S | * | 6/2010 | Puangprasert | D2/879 |
| 8,291,518 | B1 | * | 10/2012 | Davenport | 2/172 |
| 2002/0144334 | A1 | | 10/2002 | Brooks | |
| 2004/0060098 | A1 | * | 4/2004 | Landers | 2/195.1 |
| 2006/0010567 | A1 | * | 1/2006 | Vazquez et al. | 2/175.1 |
| 2011/0283441 | A1 | * | 11/2011 | Orman | 2/195.7 |
| 2012/0023642 | A1 | * | 2/2012 | Holland | 2/207 |

* cited by examiner

HEAD COVERING

The present invention relates in general to head covering, and more particularly concerns a novel hat.

BACKGROUND OF THE INVENTION

For background, reference is made to hats having a circular top on a cylindrical wall.

It is an important object of the invention to provide an improved hat.

SUMMARY OF THE INVENTION

A top is connected and stitched inward at its perimeter upon the top of a cylindrical wall that is stitched inward at the seam (to the rear edge of the top). The seam is stitched outward with the hat inside out and then the hat is inverted so the seam is inward. The bottom of the cylindrical wall may be folded outward and upward to create a rim which is fastened to the rear edge of the top.

The lower edge of the cylindrical wall is preferably folded upward over itself to form a rim, preferably folded up twice. These folds are attached in four places to the cylindrical wall to hold them in place.

The hat may be made of two pieces of material: a rectangular piece and a circular piece. The ends of the rectangular piece are stitched together to form a cylinder, and the circular piece is attached across one opening of the cylinder to form a flat top. The back medial edge of the flat top piece is stitched so as to be attached at one spot to the bottom edge of the rim in the back of the hat, forming a hat with a triangular structure rising to a peak at the front of the hat. The back of the hat has a top piece connecting to the bottom edge of the rim of the hat, creating a triangular appearance when viewed from the side so that the hat may be worn with the top of the hat slanting from a peak over the forehead down to the back of the neck. The hat made thus, covers the forehead, ears and back of the neck for protection against rain, snow, wind and cold, helping to prevent heat from escaping from the head.

The rectangular piece may be substantially 27" by 9", and the circular piece substantially 10" in a diameter with the hat forming a structure with a substantially 5-inch rise at the front of the hat. The folded rim is three layers thick and substantially 1¾" wide. Sets of three ¼" ribs, ⅜ inches apart may be stitched vertically on the cylindrical wall at the front, the back and at the centers of each side to add tension to the wall so that the hat clings to the head.

Numerous other features, objects and advantages will become apparent from the following description when read in connection with the accompanying drawing in which:

DETAILED DESCRIPTION

Figure 1:
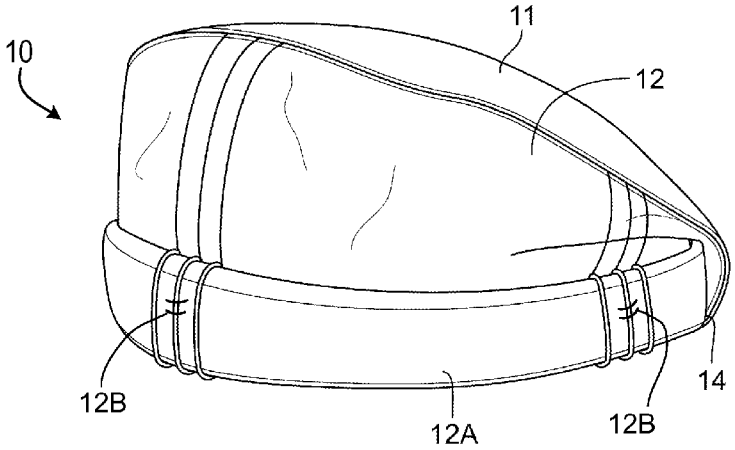
FIG. 1 is a perspective view of an embodiment of the invention.
Figure 2:
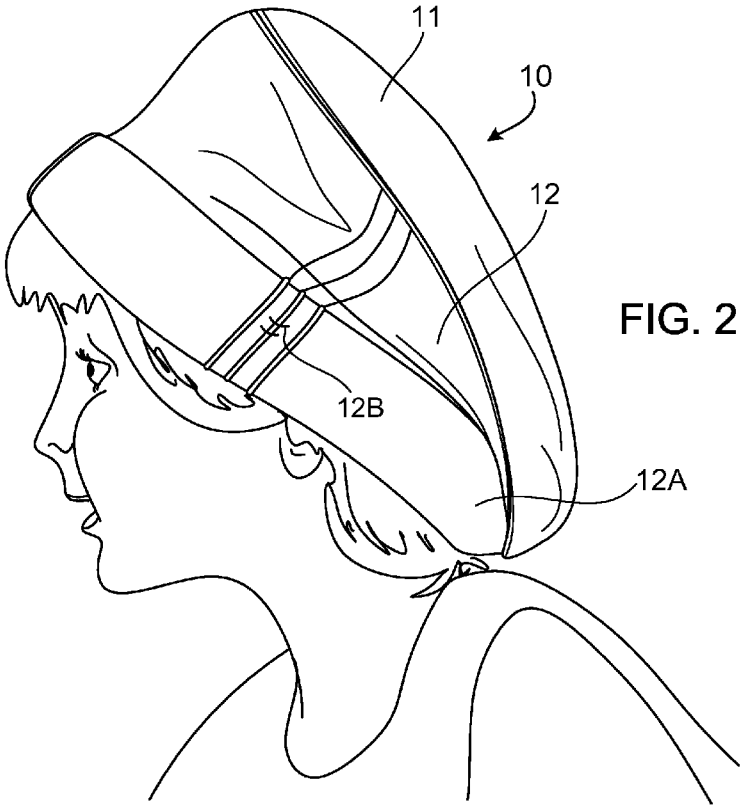
FIG. 2 is a view of the embodiment of FIG. 1 .covering the head of a wearer.

Referring to FIG. 1, there is shown a perspective view of an embodiment of the invention. A circular top 11 is fastened at its circumference to the top edge of a cylindrical wall 12. The lower edge of cylindrical wall 12 is folded outwardly upon itself to form a rim 12A three layers of fabric thick. The rear juncture of the cylindrical wall 12 and the top 11 is folded downward and connected to a rear point 14 on the lower edge of rim 12A to form a hat with a generally triangular side plan view as shown in FIG. 2 while covering the forehead, temples and ears of the wearer with rim 12A.

Figure 3:
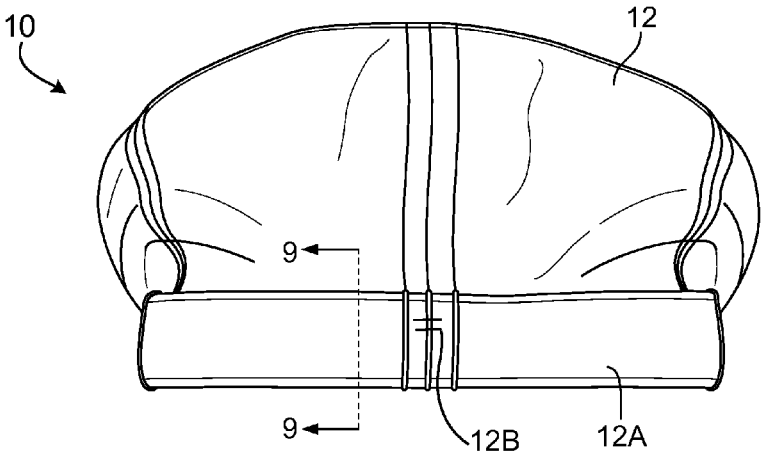
FIG. 3 is a rear view of the embodiment of FIG. 1.

Referring to FIG. 3, there is shown a front view of the embodiment of FIG. 1.

Figure 4:
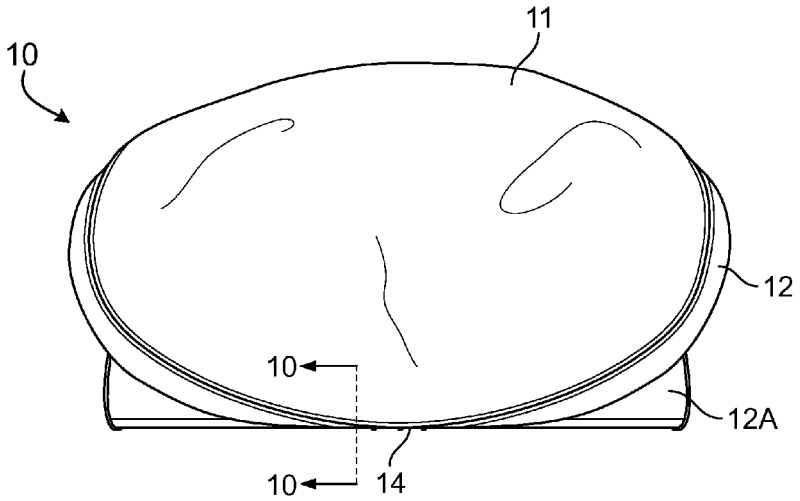
FIG. 4 is a top view of the embodiment of FIG. 1.

Referring to FIG. 4 there is shown a rear view of the embodiment of FIG. 1.

Figure 5:
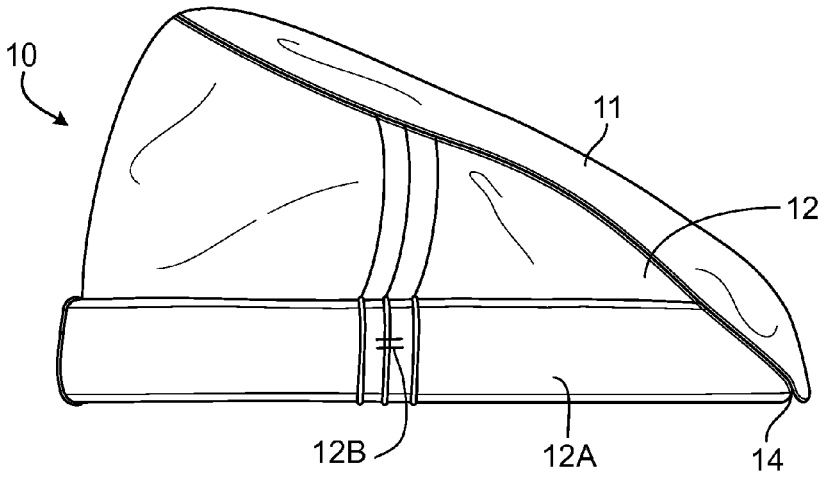
FIG. 5 is a left side view and FIG. 6 is a right side view of the embodiment of FIG. 1.

Referring to FIG. 5, there is shown a left side view of the embodiment of FIG. 1.

Figure 6:
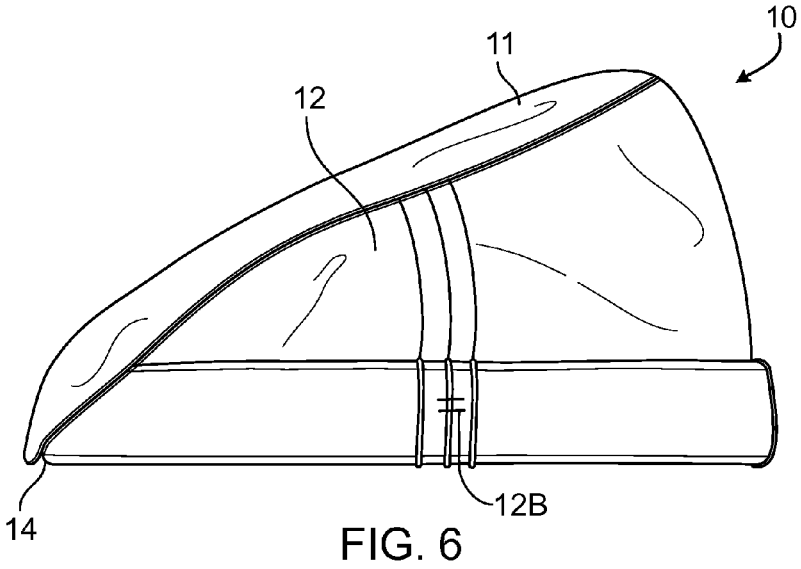

Referring to FIG. 6 there is shown a right side view of the embodiment of FIG. 1.

Figure 7:
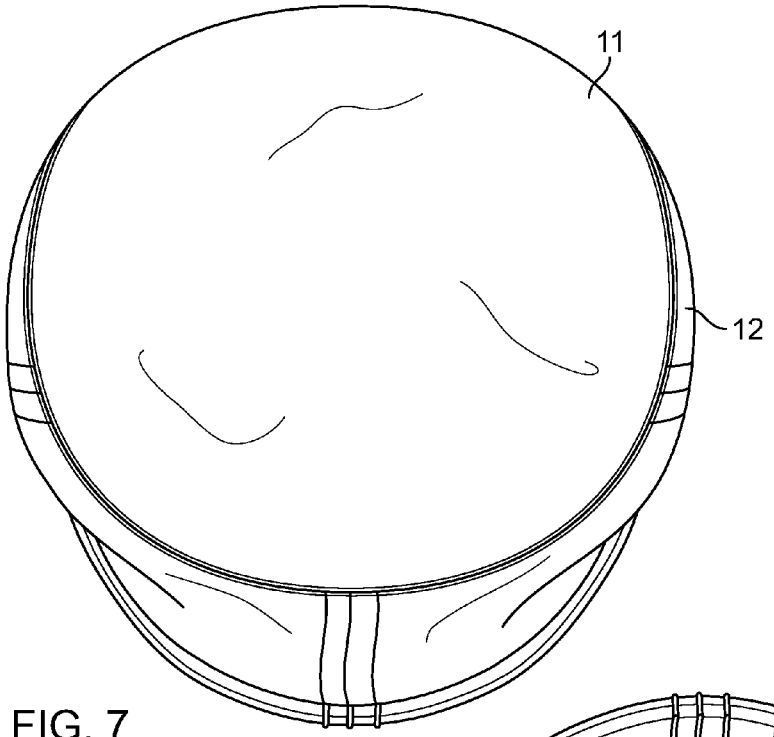
FIG. 7 and FIG. 8 are top and bottom views, respectively.

Referring to FIG. 7 there is shown a top perspective view of the embodiment of FIG. 1.

Figure 8:
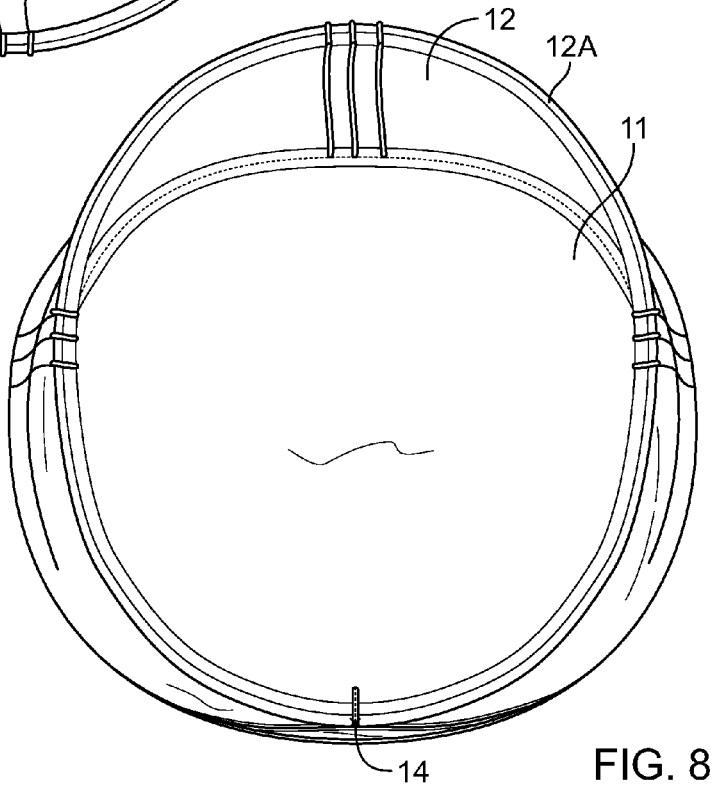

Referring to FIG. 8, there is shown a bottom perspective view of the embodiment of FIG. 1 looking toward the front.

Figure 9:
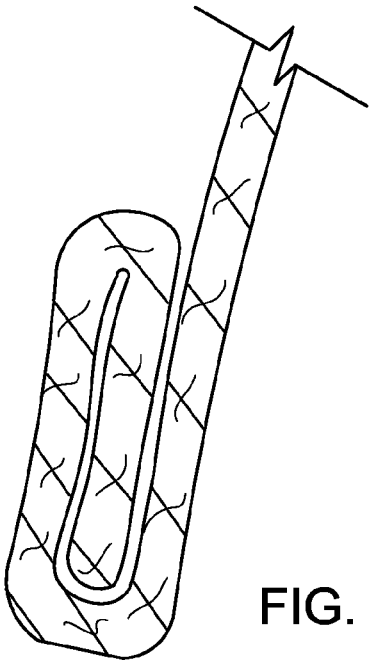
FIG. 9 is a sectional view through section 9-9 of FIG. 3.

Referring to FIG. 9, there is shown a sectional view through section 9-9 of FIG. 3 illustrating the three layers formed at the rim of the hat.

Figure 10:
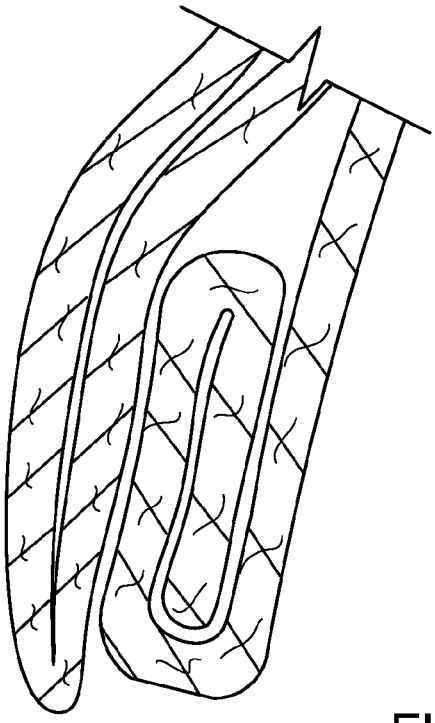
FIG. 10 is a sectional view through section 10-10 of FIG. 4.

Referring to FIG. 10, there is shown a sectional view through section 10-10 of FIG. 4 showing the five layers where the top, sides and rim overlap in the hat.

In a specific embodiment all the fastening occurs with stitches, such as 12B. However, other techniques for fastening may be employed. The cylindrical wall could be one-piece rectangular section joined together at the ends.

A specific form of the invention uses folds of fabric to retain heat in vital areas by providing multiple layers of fabric, such as three from the rim 12A, around the forehead and temples, and more layers of fabric, such as five, around the back of the head and upper neck, three from the rim 12A, a fourth from the top of the cylindrical wall 12 and a fifth from the rear of the top 10.

The circular top 11 is connected at its perimeter upon the top of the cylindrical wall of fabric 12. The bottom edge of the cylindrical wall is folded upward and outward twice to create a rim three layers thick and typically 1¾" wide. This rim is stitched down to the wall 12 at four quadrants. At the center rear, the juncture of the circular top 11 and the vertical wall 12 is connected to the bottom rear edge of the folded rim, creating a triangular shape to the hat when viewed from the side.

Three ¼" ribs, typically ⅜" apart, are stitched vertically in the cylindrical wall at the front, the back and at the center of each side to add tension to the wall so that the hat clings to the head. These ribs additionally form decorative elements, creating outward ribs on the folded rim and inward vertical lines on the sides of the hat.

It is evident that those skilled in the art may now make numerous uses and modifications of and departures from the specific structure and techniques described herein without departing from the invention concepts. Consequently, the invention is to be construed as embracing each and every novel feature and novel combination of features present in or possessed by the structure and techniques disclosed herein and limited only by the spirit and scope of the appended claims.

What is claimed is:

1. A head covering comprising a back and front top cover having a perimeter and rear edge point, a cylindrical wall having an upper edge connected to the perimeter of the top cover, the cylindrical wall having a lower rear edge point connected directly to the rear edge point of the top cover, the cylindrical wall formed from a rectangular piece having a length and width with width ends of the rectangular piece stitched together, a bottom edge of the cylindrical wall folded up twice to form three folded layers that are stitched to a body of the head covering to hold the folded layers in place, the top cover formed from a circular piece attached across one opening of the cylindrical wall, wherein a back medial edge of the top cover stitched to one spot to a bottom edge of the folded layers in the back of the head covering such that the head covering has a structure with a rise at the front of the head covering, the back of the head covering having the top piece connected to the bottom edge such that the head covering has a triangular appearance when viewed from the side so that the head covering may be worn with the top of the head covering slanting from a peak at the front over the forehead down to the back over the neck.

2. A head covering in accordance with claim 1 wherein the top cover is circular.

3. A head covering in accordance with claim 1 wherein a lower edge of the cylindrical wall is folded upward to form a rim.

4. The head covering in accordance with claim 1 wherein the rectangular piece is substantially 27 inches by 9 inches and the circular piece is substantially 10 inches in diameter with the structure having a substantially 5 inch rise at the front of the hat.

5. The head covering in accordance with claim 4 formed with a rim three layers thick and substantially 1¾ inches wide, wherein three ¼" ribs, ⅜ inches apart are stitched vertically in the cylindrical wall at the front, the back and at the center of each side to add tension to the wall so that the hat clings to the head.

* * * * *